US008991051B2

(12) United States Patent
Ishimatsu et al.

(10) Patent No.: US 8,991,051 B2
(45) Date of Patent: Mar. 31, 2015

(54) MANUFACTURING METHOD OF LIQUID DISCHARGE HEAD

(71) Applicant: Canon Kabushiki Kaisha, Tokyo (JP)

(72) Inventors: Shin Ishimatsu, Yokohama (JP); Kenji Fujii, Yokohama (JP); Toshiaki Kurosu, Kawasaki (JP); Takanobu Manabe, Kawasaki (JP); Chiaki Muraoka, Kawaguchi (JP); Sayaka Takahashi, Kawasaki (JP); Yukuo Yamaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 285 days.

(21) Appl. No.: 13/706,670

(22) Filed: Dec. 6, 2012

(65) Prior Publication Data

US 2013/0152391 A1 Jun. 20, 2013

(30) Foreign Application Priority Data

Dec. 16, 2011 (JP) ..... 2011-275851

(51) Int. Cl.

| | |
|---|---|
| ***B21D 53/00*** | (2006.01) |
| ***B41J 2/16*** | (2006.01) |
| *B41J 2/14* | (2006.01) |

(52) U.S. Cl.

CPC ..... *B41J 2/1621* (2013.01); *B41J 2/1603* (2013.01); *B41J 2/162* (2013.01); *B41J 2/1631* (2013.01); *B41J 2/1632* (2013.01); *B41J 2/1635* (2013.01); *B41J 2002/14475* (2013.01); *B41J 2202/11* (2013.01)

USPC ..... 29/890.1; 29/592.1; 29/25.35; 347/44; 347/65; 347/66; 347/85; 347/86

(58) Field of Classification Search

USPC ..... 29/25.35, 592.1, 890.1; 347/40, 44, 65, 347/66, 85, 86; 156/252, 292

See application file for complete search history.

(56) References Cited

U.S. PATENT DOCUMENTS

2008/0160454 A1* 7/2008 Shimomura et al. ..... 430/320
2009/0162797 A1 6/2009 Tsuji et al.

FOREIGN PATENT DOCUMENTS

JP 2009-166492 A 7/2009

* cited by examiner

*Primary Examiner* — Paul D Kim
(74) *Attorney, Agent, or Firm* — Fitzpatrick, Cella, Harper & Scinto

(57) ABSTRACT

This invention is a manufacturing method of a liquid discharge head that includes a substrate having a plurality of discharge energy generating elements that generate energy that is utilized for discharging a liquid, and a discharge port forming member that constitutes a discharge port group including a plurality of discharge ports that discharge the liquid and flow paths that communicate with the discharge port group. The manufacturing method includes (1) disposing a photosensitive resin as material of the discharge port forming member on or above the substrate, and (2) forming an exposure pattern of the discharge port group using ultraviolet light in the photosensitive resin. In the aforementioned (2), the discharge port group is divided in a longitudinal direction and exposed, and the exposures are respectively performed so that regions in which there is a high degree of telecentricity face each other.

11 Claims, 7 Drawing Sheets

MANUFACTURING METHOD OF LIQUID DISCHARGE HEAD

BACKGROUND OF THE INVENTION

1. Field of the Invention

The present invention relates to a method of manufacturing a liquid discharge head that discharges a liquid.

2. Description of the Related Art

For example, an inkjet recording method that performs recording by discharging ink onto a recording medium is used in a liquid discharge head that discharges a liquid.

As a method of manufacturing a liquid discharge head, Japanese Patent Application Laid-Open No. 2009-166492 discusses a method that uses an i-line exposure apparatus that employs a projection method. The liquid discharge head discussed in Japanese Patent Application Laid-Open No. 2009-166492 includes a substrate that has discharge energy generating elements, and a discharge port forming member that constitutes discharge ports and liquid flow paths. Manufacture thereof is performed in the following manner. First, a flow path pattern of the liquid flow paths is formed on or above the substrate using a positive-type photosensitive resin. Next, a negative-type photosensitive resin is formed as the material of the discharge port forming member on the flow path pattern. Subsequently, the negative-type photosensitive resin is exposed using i-line illumination, and the discharge ports are formed by patterning.

According to this method, discharge ports with a favorable circular shape can be obtained simply and with good reproducibility.

SUMMARY OF THE INVENTION

The present invention is a manufacturing method of a liquid discharge head that includes a substrate having a plurality of discharge energy generating elements that generate energy that is utilized for discharging a liquid, and a discharge port forming member that comprises a discharge port group comprising a plurality of discharge ports that discharge the liquid and flow paths that communicate with the discharge port group, the method including: (1) disposing a photosensitive resin as a material of the discharge port forming member on or above the substrate; and (2) forming an exposure pattern of the discharge port group in the photosensitive resin using ultraviolet light; wherein, in the forming of (2), the discharge port group is divided in a longitudinal direction and exposed, and the exposures are respectively performed so that regions in which there is a high degree of telecentricity face each other.

Further features of the present invention will become apparent from the following description of exemplary embodiments with reference to the attached drawings.

DESCRIPTION OF THE EMBODIMENTS

Figure 1A:
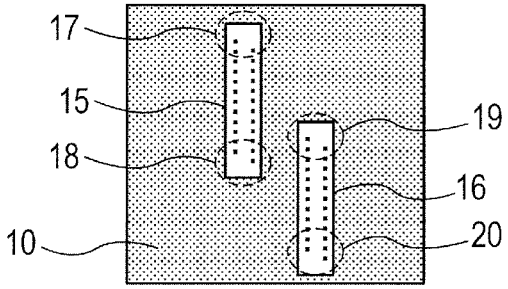
FIG. 1A is a schematic plan view that illustrates a configuration example of a mask that is used in an exposure process.

Preferred embodiments of the present invention will now be described in detail in accordance with the accompanying drawings.

When forming a discharge port group of an inkjet recording head that is equal to or greater than an angle of view size by means of a projection-type exposure apparatus that uses i-line light, a method is generally adopted in which exposure is performed after dividing the discharge port group so that the discharge port group fits within the angle of view. That is, the discharge port group is divided in the longitudinal direction of a nozzle chip and exposed. When performing such kind of divided exposure, if a boundary section (hereunder, also referred to as "joint part") at which the discharge port group is divided is disposed on an outer circumferential side in the angle of view, discharge ports in the vicinity of the boundary section will formed in a manner in which the discharge ports are affected by telecentricity that is caused by the optical system of the i-line exposure apparatus. When discharge ports that have been affected by telecentricity are slantingly formed relative to the vertical direction of the substrate, liquid that is discharged from the discharge ports in the vicinity of the joint part will impact against the recording medium at positions that deviate significantly from the ideal impact positions. Consequently, when recording is performed by discharging ink onto a recording medium using an inkjet recording head that includes such discharge ports, a situation will arise in which the impact positions of image dots formed by a discharge port group in the vicinity of the joint part will deviate and the image quality will deteriorate.

An object of the present invention is to provide a manufacturing method of a liquid discharge head that is capable of reducing the influence of telecentricity with respect to a method that fabricates a discharge port group of a liquid discharge head by dividing the discharge port group.

In a liquid discharge head obtained by the manufacturing method according to the present invention, discharge ports that are affected by telecentricity and slantingly formed are disposed on a center side of a discharge port group. That is, discharge ports that are affected by telecentricity and for which a deviation occurs in impact positions of liquid discharged therefrom are disposed on the center side of a discharge port group. Discharge ports on a center side of a discharge port group do not print at a leading edge or a trailing edge of a recording medium at which the influence of a deviation in impact positions is noticeable. Accordingly, a liquid discharge head obtained by the manufacturing method of the present invention can obtain an image in which a lowering of image quality due to the influence of telecentricity is minor.

Further, although in the following description an example of an inkjet recording head is mainly described as an application example of the present invention, the application range of the present invention is not limited thereto, and the present invention can also be applied to a liquid discharge head that is used for manufacturing a biosensor chip or for printing electronic circuits or the like. In addition to an inkjet recording head, for example, a head for manufacturing a color filter may also be mentioned as a liquid discharge head.

Figure 4:
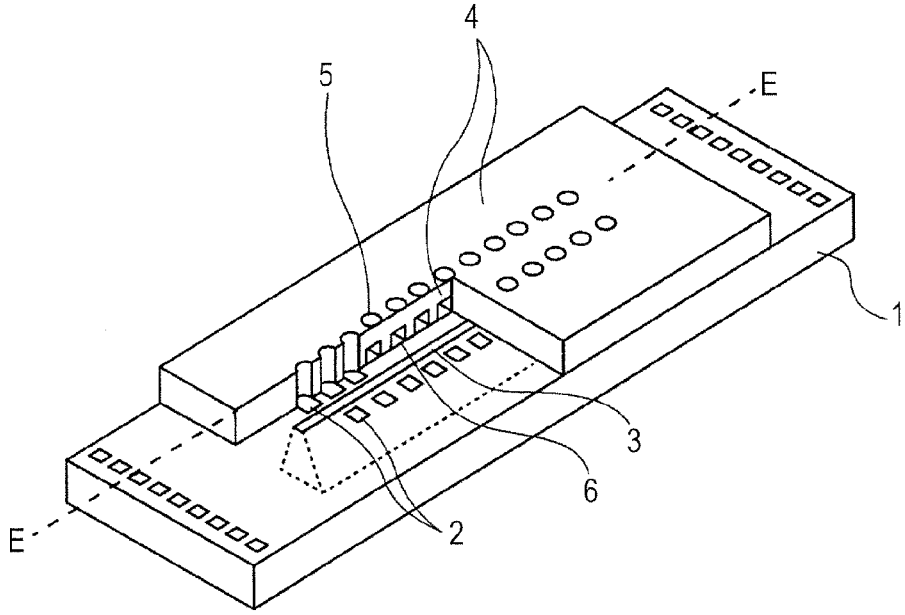
FIG. 4 is a schematic perspective view that illustrates a configuration example of a general inkjet recording head.

FIG. 4 is a schematic view that illustrates a configuration example of a general inkjet recording head. In FIG. 4, discharge energy generating elements 2 are formed in two rows at a predetermined pitch on a recording element substrate 1. A supply port 3 formed by crystal anisotropic etching of silicon is formed in the recording element substrate 1 so as to open between the two rows of discharge energy generating elements 2. A discharge port forming member 4 is also formed on the recording element substrate 1. The discharge port forming member 4 constitutes a discharge port group including a plurality of discharge ports 5 and also flow paths 6 that communicate with the discharge port group. The discharge ports 5 are formed at positions that face the discharge energy generating elements, respectively. The flow paths 6 communicate with the supply port 3 and the discharge ports 5.

Figure 5:
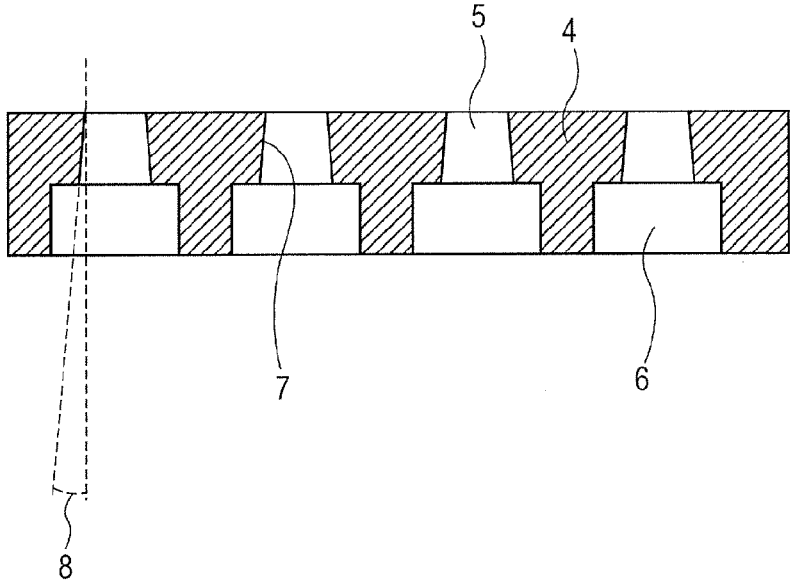
FIG. 5 is a schematic cross-sectional view that illustrates a cross section along a line E-E in FIG. 4.

FIG. 5 is a schematic cross-sectional view of the discharge port forming member 4 on a plane that is perpendicular to the substrate along a line E-E in FIG. 4. Each discharge port 5 has an opening on the surface of the discharge port forming member 4 and communicates with the corresponding flow path 6. A side face 7 in the discharge port 5 has a tapered shape. An angle (taper angle) 8 is formed between a perpendicular direction to the substrate surface and the side face that has the tapered shape.

A method for forming the discharge port forming member includes, first, forming a positive-type photosensitive resin layer on the recording element substrate 1, and patterning the positive-type photosensitive resin by a photolithography step to form a flow path pattern to serve as a mold of the flow path. Next, a negative-type photosensitive resin layer is formed as the material of the discharge port forming member 4 on the recording element substrate 1 on which the flow path pattern has been formed. Subsequently, pattern exposure is performed using ultraviolet light (for example, i-line light) through a discharge port mask (reticle) 10, and a developing process is performed to thereby form the discharge ports 5. For example, a commercially available i-line stepper is used as the apparatus that exposes the discharge ports 5.

Figure 6:
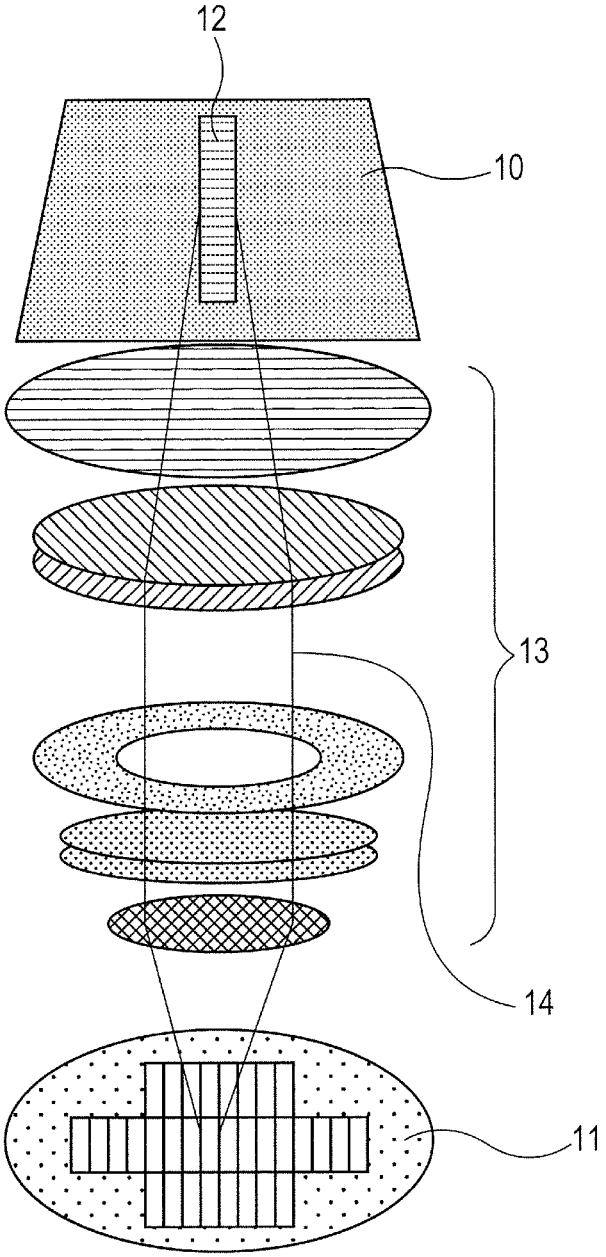
FIG. 6 is a schematic view that illustrates an image of a step of forming an exposure pattern of discharge ports using an ultraviolet light (for example, i-line) stepper.

FIG. 6 is a schematic view that illustrates an image of a process that exposes a pattern of the discharge ports 5 using an i-line stepper. A plurality of the recording element substrates 1 is disposed on a wafer 11. The respective recording element substrates 1 are cut and separated using a dicer or the like in a later step. A discharge port pattern formation region 12 is provided in the discharge port mask. Laser light 14 that passes through the pattern is projected onto the wafer through a lens unit 13 to expose the pattern of the discharge ports.

Exemplary embodiments of the present invention are described below with reference to the drawings.

Exemplary Embodiment 1

According to the present exemplary embodiment, a discharge port group is divided and exposed by ultraviolet light (for example, i-line light). Although an i-line stepper can be used in the present invention, the present invention is not limited thereto. Further, an exposure apparatus that adopts an optical reduction system is used in the present exemplary embodiment.

According to the present exemplary embodiment, first a substrate that includes a plurality of discharge energy generating elements on a first face is prepared, and a flow path pattern is formed on the first face side of the substrate as a mold of a flow path using positive-type photosensitive resin.

Next, a photosensitive resin as material of a discharge port forming member is disposed on the flow path pattern and the substrate. For example, a negative-type photosensitive resin can be used as the photosensitive resin.

Next, an exposure pattern of a discharge port group is formed using ultraviolet light in the photosensitive resin. At this time, the discharge port group is divided in the longitudinal direction and exposed, and the respective exposures are performed so that regions in which there is a high degree of telecentricity face each other.

The exposure process is described in detail below.

Figure 1B:
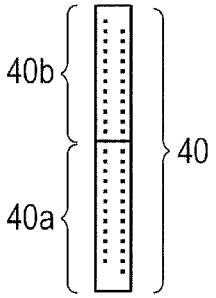
FIG. 1B is a schematic view that illustrates an example of an exposure pattern formed by exposure in an exposure process.

FIG. 1A is a schematic plan view illustrating a configuration example of a mask that is used in the exposure process. FIG. 1B is a schematic view illustrating an example of an exposure pattern formed by exposure in the exposure process. In FIGS. 1A and 1B, a portion that is exposed using a first shot pattern 15 corresponds to a first exposure pattern 40*a*. Further, a portion that is exposed using a second shot pattern 16 corresponds to a second exposure pattern 40*b*. An exposure pattern 40 that corresponds to the discharge port group includes the first exposure pattern 40*a* and the second exposure pattern 40*b*.

As illustrated in FIG. 1A, the mask 10 that is used in the exposure process includes the first shot pattern 15 and the second shot pattern 16.

Figure 2A:
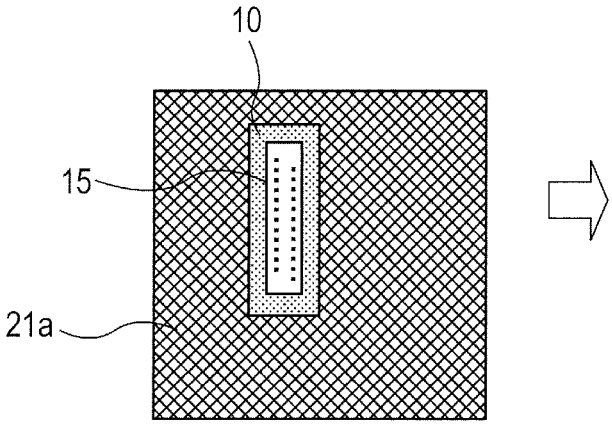
FIGS. 2A and 2B are schematic plan views for describing an exposure step according to an exemplary embodiment of the present invention.
Figure 2B:
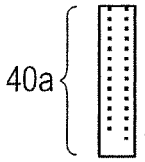
Figure 3A:
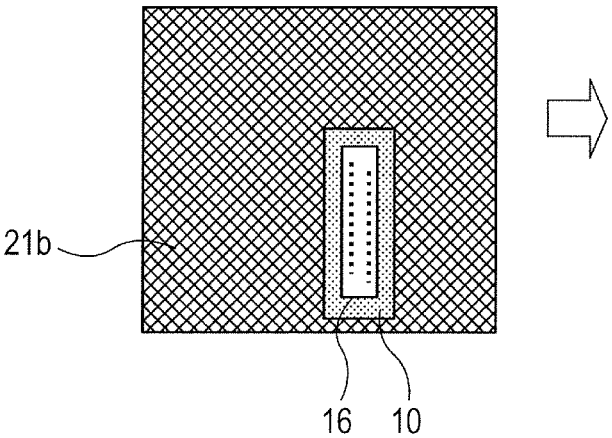
FIGS. 3A and 3B are schematic plan views for describing an exposure step according to the exemplary embodiment that is a continuation of the exposure step illustrated in FIGS. 2A and 2B.
Figure 3B:
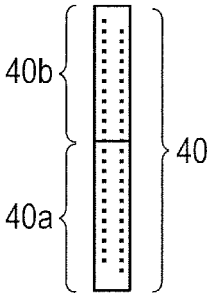

First, as illustrated in FIGS. 2A and 2B, a first exposure operation (hereunder, also referred to as "first exposure") is performed using the first shot pattern 15, and an exposure pattern (the first exposure pattern 40*a*) of the lower half of the discharge port group is formed in the photosensitive resin as the material of the discharge port forming member. Thereafter, as illustrated in FIGS. 3A and 3B, a second exposure operation (hereunder, also referred to as "second exposure") is performed using the second shot pattern 16, and an exposure pattern of the upper half of the discharge port group is formed in the photosensitive resin.

In this case, in FIG. 1A, in the first shot pattern 15, a portion 17 at which there is a high degree of telecentricity and a portion 18 at which there is a low degree of telecentricity. That is, when exposing the first shot pattern 15, the portion 17 side is disposed at an exposure position at which there is a high degree of telecentricity, while the portion 18 side is disposed at an exposure position at which there is a low degree of telecentricity. The term "exposure position at which there is a high degree of telecentricity" refers to, for example, a position that corresponds to an outer circumferential side of the lens. The term "exposure position at which there is a low degree of telecentricity" refers to, for example, a position that corresponds to a center side of the lens. Accordingly, the first shot pattern can be disposed in a radial direction from a position corresponding to the center of the lens of the exposure apparatus towards a position corresponding to the outer circumference of the lens. That is, at a time of exposure, a shot pattern for forming the exposure pattern of the discharge ports can be disposed within an area that corresponds to a region from the center to the outer circumference of the lens along a direction (radial direction) towards the outer circumference from the center of the lens.

Further, in the second shot pattern 16, a portion 20 at which there is a high degree of telecentricity and a portion 19 at which there is a low degree of telecentricity. That is, when exposing the second shot pattern 16, the portion 20 side is disposed at an exposure position at which there is a high degree of telecentricity, while the portion 19 side is disposed at an exposure position at which there is a low degree of telecentricity.

The first exposure pattern 40*a* and the second exposure pattern 40*b* are joined so that regions formed by exposure using the portions 17 and 20 at which there is a high degree of telecentricity face each other to thereby constitute the discharge port pattern 40. On the other hand, the portion 18 at which there is a low (favorable) degree of telecentricity in the first shot pattern 15 and the portion 19 at which there is a low (favorable) degree of telecentricity in the second shot pattern 16 are disposed at a first segment and a last segment of the discharge port group, respectively.

FIGS. 2A and 2B are schematic plan views for describing a step of forming the first exposure pattern 40*a* by the first exposure. A first mask shutter 21*a* illustrated in FIGS. 2A and 2B is used in the first exposure. The first mask shutter 21*a* blocks laser light of an area other than the area of the first shot pattern 15 at the time of the first exposure. The mask shutter is configured to be movable when switching between the first exposure and the second exposure (which is also a time of movement of a work stage).

FIGS. 3A and 3B are schematic plan views for describing a step of forming the second exposure pattern 40*b* by the second exposure. A second mask shutter 21*b* illustrated in FIGS. 3A and 3B is used in the second exposure. The second mask shutter 21*b* blocks laser light of an area other than the area of the second shot pattern 16 at the time of the second exposure.

Since a projection exposure apparatus that performs exposure by reducing a mask pattern is used as the exposure apparatus, the exposure patterns of the discharge ports are affected by telecentricity. Therefore, a taper angle of a discharge port formed by exposure at a portion at which there is a high degree of telecentricity is a large angle in comparison to a taper angle of a discharge port formed by exposure at a portion at which there is a low degree of telecentricity.

Figure 7:
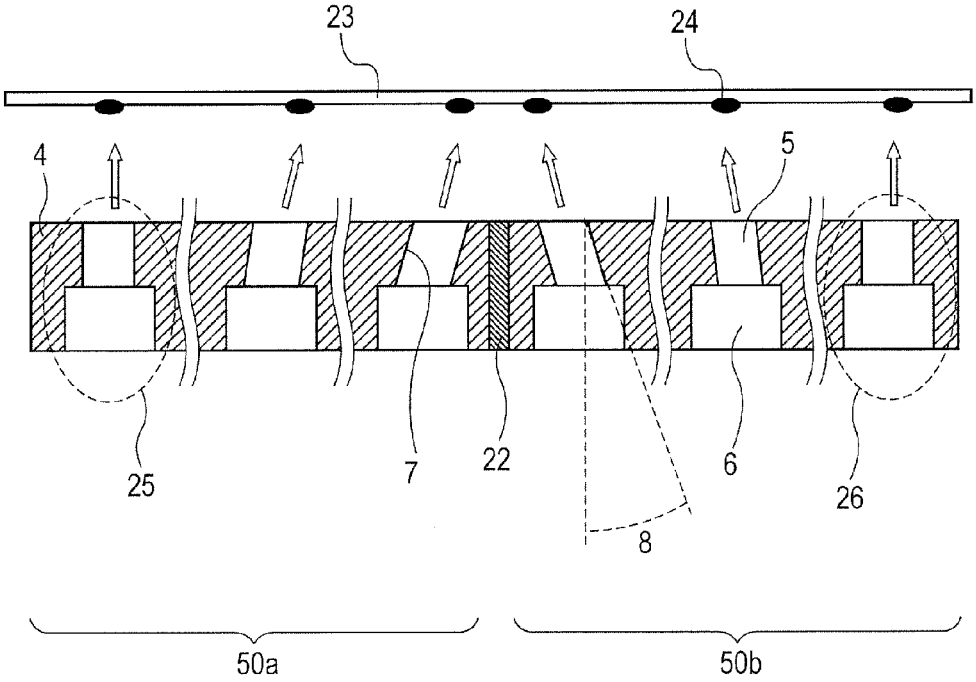
FIG. 7 is a schematic cross-sectional view for describing a configuration example of an inkjet recording head that is obtained by a manufacturing method according to an exemplary embodiment.

FIG. 7 is a schematic cross-sectional view for describing a configuration example of a liquid discharge head manufactured by the manufacturing method of the present exemplary embodiment. FIG. 7 is a cross-sectional view on a plane that is perpendicular to the substrate along the line E-E in FIG. 4. Note that, in FIG. 7, in order to facilitate visualization of the invention of the present application, in some cases the size of a taper angle may be depicted in an exaggerated manner.

The example illustrated in FIG. 7 includes a boundary part (joint part) 22 and a recording medium 23, and illustrates a state in which ink droplets 24 are discharged from the respective discharge ports 5 and impact against the recording medium 23. A first segment 25 and a last segment 26 are the first and last segments in the discharge port group, respectively. A first discharge port group 50*a* corresponds to the first exposure pattern 40*a* formed by the first exposure. A second discharge port group 50*b* corresponds to the second exposure pattern 40*b* formed by the second exposure. The boundary part can be provided in the vicinity of the center of the discharge port group. Note that the boundary part is merely a part that is illustrated as a guide for describing the vicinity of the center of the discharge port group according to the present invention, and the boundary part does not denote an area where the material is particularly different. A difference between the number of discharge ports of the first discharge port group 50*a* and the number of discharge ports of the second discharge port group 50*b* can be ten or less, furthermore can be five or less, moreover can be one or less, and in particular can be the same. In FIG. 7, the flow paths 6 are provided at regular intervals.

As illustrated in FIG. 7, the discharge port group formed according to the present exemplary embodiment includes the boundary part 22 in the longitudinal direction of the discharge port group, and is formed as two regions (the first discharge port group 50*a* and the second discharge port group 50*b*) that are separated at the boundary part 22. In the first discharge port group 50*a*, the respective taper angles 8 of the discharge ports gradually decrease in the direction from the discharge port adjacent to the boundary part 22 towards the discharge port of the first segment 25. In the second discharge port group 50*b*, the respective taper angles 8 of the discharge ports gradually decrease in the direction from the discharge port adjacent to the boundary part 22 towards the discharge port of the last segment 26. The discharge ports of the first segment 25 and the last segment 26 can be formed in a substantially vertical direction with respect to the substrate face.

In the present exemplary embodiment, the exposure pattern of the discharge port group is formed by dividing the exposure pattern into an exposure pattern of the first discharge port group and an exposure pattern of the second discharge port group in the vicinity of the center in the longitudinal direction of the discharge port group. The exposure pattern of the first discharge port group and the exposure pattern of the second discharge port group are formed so that a side on which there is a high degree of telecentricity of the exposure pattern of the first discharge port and a side on which there is a high degree of telecentricity of the exposure pattern of the second discharge port face each other. The term "side on which there is a high degree of telecentricity of the exposure pattern" refers to a side on which discharge ports having a large inclination are formed in the exposure pattern. For example, in FIG. 7, the term "side on which there is a high degree of telecentricity" in the first exposure pattern refers to the boundary part 22 side thereof.

In the liquid discharge head having the discharge port group illustrated in FIG. 7, ink is discharged substantially vertically towards the recording medium 23 from the discharge ports of the first segment 25 and the last segment 26. On the other hand, the closer to the boundary part 22 side that a discharge port is, the greater the degree to which formation of the discharge port is affected by telecentricity and the discharge port is formed in an inclined manner towards the boundary part side, and hence ink droplets 24 discharged therefrom are discharged towards the inner side.

When a recording element substrate 1 having a discharge port group as illustrated in FIG. 7 was actually manufactured and the discharge performance thereof was evaluated, it was verified that the printing performance was favorable.

Figure 8:
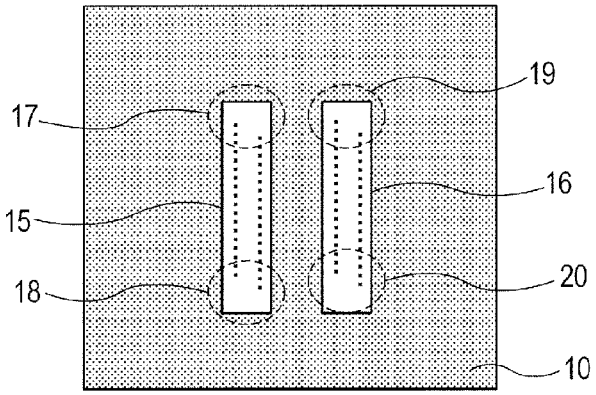
FIG. 8 is a schematic plan view that illustrates a mask on which patterns of discharge port groups were evenly disposed that were obtained by dividing a pattern in two so as to dispose the center of a shot pattern at a center portion of i-line light.

On the other hand, as a comparison, as illustrated in FIG. 8, a discharge port group was formed using a mask on which patterns of discharge port groups were evenly disposed that were obtained by dividing a pattern in two so as to dispose the center of a shot pattern at a center portion of i-line light. An inkjet recording head was manufactured using a discharge port member including the discharge port group. When printing was performed using the inkjet recording head, deterioration in the image quality was observed at the leading edge and trailing edge of the recording medium 23.

Figure 9:
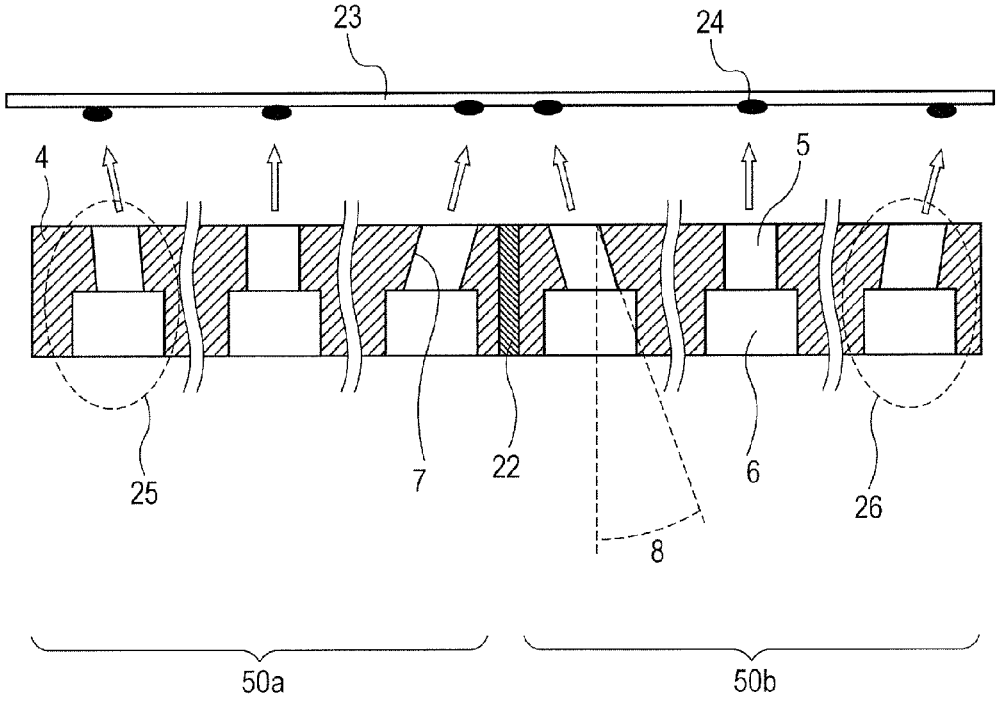
FIG. 9 is a schematic cross-sectional view that illustrates a configuration example of an inkjet recording head manufactured using the mask illustrated in FIG. 8.

FIG. 9 is a schematic view of a cross section of the discharge port member manufactured by the fabrication method illustrated in FIG. 8. As will be understood from FIG. 9, ink droplets 24 from the first segment 25 and the last segment 26 of a discharge port group 9 do not impact perpendicularly against the recording medium 23.

The manufacturing method of the present exemplary embodiment is useful when manufacturing an inkjet recording head for which it is necessary to perform joining exposure and fabricate the discharge port group 9, such as in the case of a long head. An inkjet recording head that is a long head is generally utilized for a medium for which high-speed printing is required. An inkjet recording head that is a long head is used, for example, when printing on a recording medium with a wide area such as a poster or banner paper, or a flag. When printing on these kinds of recording media, printing is frequently performed as far as the edges of the relevant recording medium.

Note that, although according to the present exemplary embodiment an example has been described in which the exposure pattern of a discharge port is formed using a mask or a mask shutter having a configuration as illustrated in FIGS. 1A to 3B, the present invention is not limited thereto.

Exemplary Embodiment 2

According to the present exemplary embodiment, a unit that improves impact accuracy is described.

According to the present exemplary embodiment, spaces between adjacent discharge ports are adjusted on a mask so as to briefly become narrower as the spaces approach the boundary part 22 of the discharge ports (position at which regions in which there is a high degree of telecentricity face each other), and the exposure pattern is divided to perform fabrication of the discharge ports. According to Exemplary Embodiment 1, although ink droplets from the first segment 25 and the last segment 26 impact in a substantially perpendicular direction against the recording medium 23, there is a tendency for the ink droplets to impact against the recording medium 23 in a manner such that the ink droplets gradually widen as the position of the relevant discharge port approaches the boundary part 22, that is, the position at which the first discharge port group and the second discharge port group are facing. The present exemplary embodiment relates to a unit that reduces this tendency.

Figure 10:
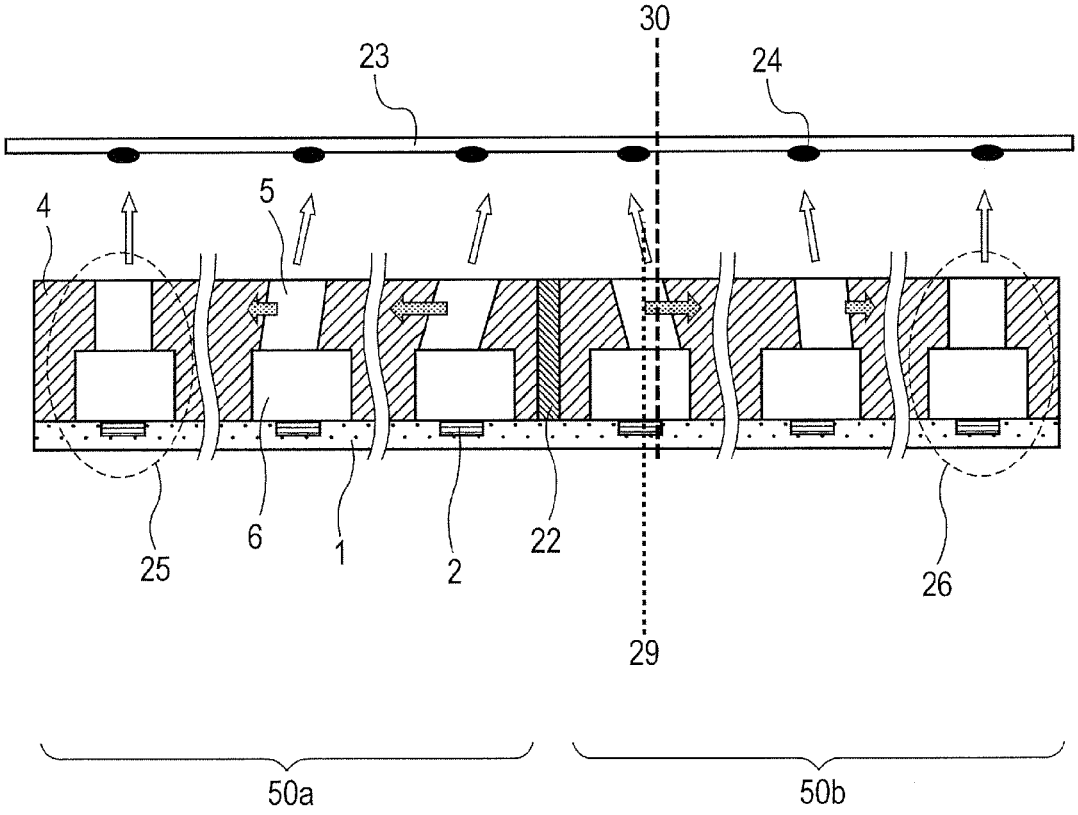
FIG. 10 is a schematic cross-sectional view that illustrates a configuration example of an inkjet recording head obtained according to Exemplary Embodiment 2.

FIG. 10 is an image view of a discharge port group for describing an adjustment method according to the present exemplary embodiment. In FIG. 10, the arrangement of the flow paths 6 and the discharge energy generating elements 2 is the same as in FIG. 7, and the flow paths 6 and the discharge energy generating elements 2 are arranged at regular intervals. The first discharge port group 50*a* and the second discharge port group 50*b* are fabricated by a first exposure and a second exposure, respectively. In the first shot pattern 15 for fabricating the first discharge port group 50*a*, arrangement positions of opening patterns that correspond to discharge ports are adjusted so that the discharge ports are formed in a manner in which the discharge ports deviate to the first segment 25 side in comparison to the case illustrated in FIG. 7. The adjustment amount increases towards the boundary part 22 and decreases in accordance with proximity to the first segment 25 in accordance with the telecentricity relationship. On the other hand, in the second shot pattern 16 for fabricating the second discharge port group 50*b*, arrangement positions of opening patterns that correspond to discharge ports are adjusted so that the discharge ports are formed in a manner in which the discharge ports deviate to the last segment 26 side in comparison to the case illustrated in FIG. 7. Similarly to the first shot pattern, the adjustment amount increases towards the boundary part 22 and decreases in accordance with proximity the last segment 26 in accordance with the telecentricity relationship. A space between adjacent discharge ports is, for example, in FIG. 10, a distance between a center line at a portion that contacts with the flow path in the discharge port (boundary section with the flow path) and a center line at a portion that contacts with the flow path of a discharge port adjacent to the relevant discharge port.

According to the above described configuration, positions of discharge ports are adjusted by anticipating a direction in which impact positions deviate due to the influence of telecentricity. According to this configuration also, images can be obtained in which deterioration in the image quality due to the influence of telecentricity is minor.

When a recording element substrate 1 including the discharge port group described above was actually manufactured and utilized for an inkjet recording head and printing was performed, favorable printing results were obtained. In particular, when an image was printed in a case in which the number of printing passes was small, an image with a higher resolution in comparison to Exemplary Embodiment 1 could be obtained.

Exemplary Embodiment 3

In FIG. 10 that is used to describe Exemplary Embodiment 2, a center line 29 of each flow path 6 on the cross section in the longitudinal direction of the discharge port group and, with respect to the flow paths 6 in the same cross section, a center line 30 at a part of each discharge port 5 that contacts with the relevant flow path 6 do not coincide (see FIG. 10).

Figure 11:
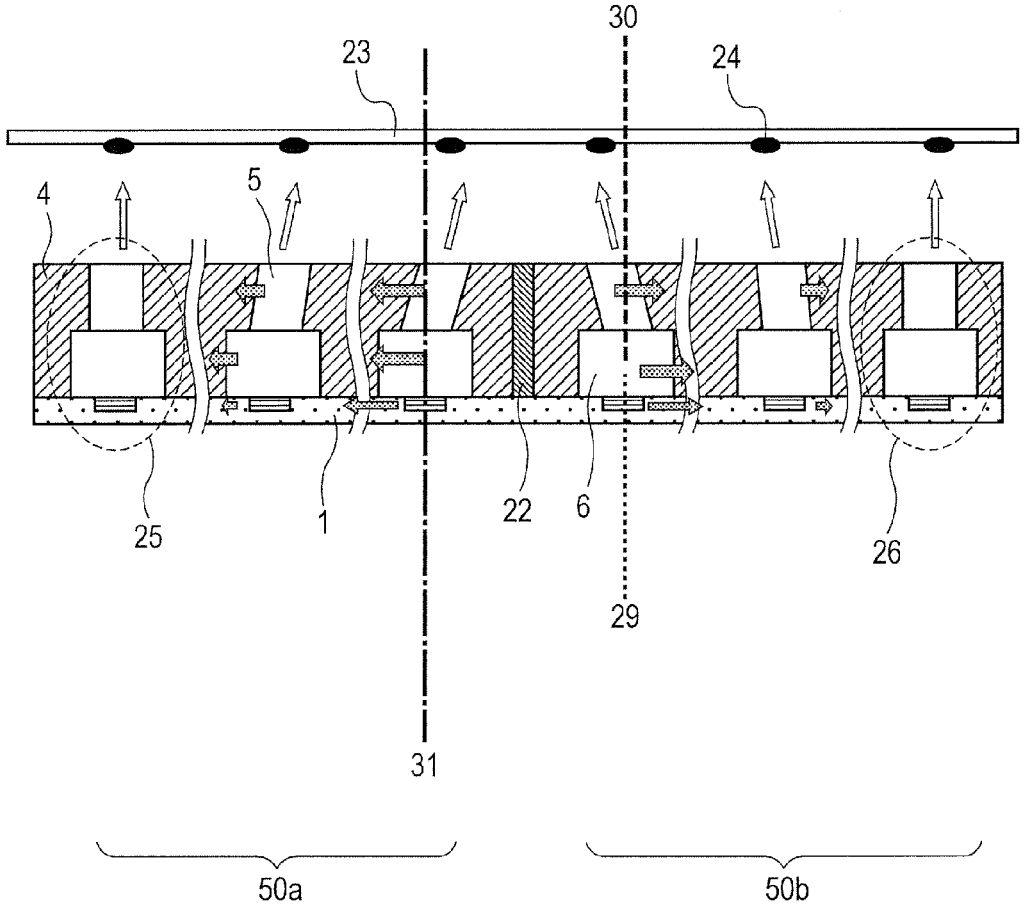
FIG. 11 is a schematic cross-sectional view that illustrates a configuration example of an inkjet recording head obtained according to Exemplary embodiment 3.

According to the present exemplary embodiment, spaces between adjacent discharge ports are adjusted on a mask so as to briefly become narrower as the spaces approach the boundary part 22 of the discharge ports and the exposure pattern is divided to perform fabrication of the discharge ports, and at the same time, the discharge energy generating elements 2 and flow paths 6 are also adjusted so as to correspond to the respective discharge ports 5. FIG. 11 is an image view for describing the adjustment method. A center line 31 of the discharge energy generating element 2 on a cross section in a longitudinal direction of the discharge port group 9 is illustrated in FIG. 11.

In FIG. 11, the center line 29 of the flow path 6 and the center line 30 of the discharge port 5 coincide. The resistance from the walls of the ink flow path 6 when ink flies is equal on the left and right sides (in the longitudinal direction of the discharge port group).

Further, since the discharge port 5 and the ink flow path 6 are at a center portion of the discharge energy generating element 2 (the center line 29 and center line 31 in FIG. 11 are coaxial and coinciding), the influence that the ink flow path 6 exerts on the discharge energy can be made uniform on the left and right sides (in the longitudinal direction of the discharge port group 9). This stabilizes the flight of the ink droplets 24. In particular, in a form that employs foaming pressure using a heater as discharge energy, defoaming of the foam is also uniformized and differences between the respective discharge ports 5 are eliminated. Consequently, the occurrence of residual air bubbles is also reduced, and the reliability of discharging is increased.

When an inkjet recording head was actually manufactured using a discharge port forming member including the discharge port group described above and printing was performed using the inkjet recording head, favorable printing results were obtained. It was possible to print high-resolution images over a longer period than in Exemplary Embodiment 2.

According to the present exemplary embodiment, the positions of the discharge energy generating elements 2, the flow paths 6 and the discharge ports 5 are adjusted relative to Exemplary Embodiment 1. Further, if routing of wiring is difficult due to modulating the spacing of the discharge energy generating elements 2, a configuration may be adopted in which only the ink flow paths 6 and the discharge ports 5 are adjusted. In addition, in a case where modulating the spacing of the flow paths 6 imparts a slight distortion to the walls of the flow paths 6 and affects the force of adhesion with the recording element substrate 1, a configuration may be adopted in which only the discharge energy generating elements 2 and the discharge ports 5 are adjusted. Accordingly, in the present exemplary embodiment, the arrangement positions of at least one kind among flow paths, discharge ports and discharge energy generating elements can be adjusted so that impact positions of liquid discharged from the discharge ports are uniform.

As illustrated in the present exemplary embodiment, each energy generating element group corresponding to a discharge port group can briefly become narrower towards the center of the discharge port group, that is, towards a position at which regions in which there is a high degree of telecentricity face each other. According to this configuration, discharge energy generating elements can be arranged at appropriate locations with respect to discharge ports and efficient discharging can be performed. This also leads to an improvement in the discharge reliability. A space between adjacent discharge energy generating elements is, for example, in FIG. 11, a distance between a center line of the relevant discharge energy generating element and a center line of a discharge energy generating element adjacent to the relevant discharge energy generating element. Further, a space between adjacent flow paths is, for example, in FIG. 11, a distance between a center line of the relevant flow path and a center line of a flow path adjacent to the relevant flow path.

In addition, as illustrated in the present exemplary embodiment, on a cross section in the longitudinal direction of the discharge port group, a center line of the respective flow paths and a center line at a portion that contacts with the relevant flow path of a discharge port that corresponds to the relevant flow path can coincide. According to this configuration, a discharge port can be arranged at a center position in an ink flow path, and the resistance from the walls of the ink flow path when ink flies is equal is equal on the left and right sides (in the longitudinal direction of the discharge port group). As a result, the flight of ink from the discharge ports is favorable and the impact accuracy is raised, and furthermore, the occurrence of satellite ink droplets is suppressed, thus contributing to the acquisition of a favorable image.

Furthermore, as illustrated in the present exemplary embodiment, on a cross section in the longitudinal direction of the discharge port group, a center line of the respective flow paths, a center line at a portion that contacts with the relevant flow path of a discharge port that corresponds to the relevant flow path, and a center line of an energy generating element that corresponds to the relevant flow path can coincide. According to this configuration, the influence the respective ink flow paths exert on the generated discharge energy can be made uniform on the left and right sides (in the longitudinal direction of the discharge port group). This also makes the flight of ink droplets favorable and contributes to acquisition of a favorable image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-275851, filed Dec. 16, 2011, which is hereby incorporated by reference herein in its entirety.

What is claimed is:

1. A manufacturing method of a liquid discharge head that includes a substrate having a plurality of discharge energy generating elements that generate energy that is utilized for discharging a liquid, and a discharge port forming member that comprises a discharge port group comprising a plurality of discharge ports that discharge the liquid and flow paths that communicate with the discharge port group, the method including:

(1) disposing a photosensitive resin as a material of the discharge port forming member on or above the substrate; and (2) forming an exposure pattern of the discharge port group in the photosensitive resin using ultraviolet light;

wherein, in the forming of (2), the discharge port group is divided in a longitudinal direction and exposed, and the exposures are respectively performed so that regions in which there is a high degree of telecentricity face each other.

2. The manufacturing method of a liquid discharge head according to claim 1, wherein, in the forming of (2), the exposure pattern of the discharge port group is formed by being divided into an exposure pattern of a first discharge port group and an exposure pattern of a second discharge port group in a vicinity of a center in the longitudinal direction of the discharge port group, and the exposure pattern of the first discharge port group and the exposure pattern of the second discharge port group are formed so that a side on which there is a high degree of telecentricity of the exposure pattern of the first discharge port group and a side on which there is a high degree of telecentricity of the exposure pattern of the second discharge port group face each other.

3. The manufacturing method of a liquid discharge head according to claim 2, wherein:

the exposure pattern of the first discharge port group and the exposure pattern of the second discharge port group are formed by a first exposure and a second exposure using a mask having a shot pattern, respectively; and the shot pattern is disposed along a radial direction of a lens of an exposure apparatus that is used for the exposures and within an area that corresponds to a region from a center to an outer circumference of the lens.

4. The manufacturing method of a liquid discharge head according to claim 1, wherein on a cross section in a longitudinal direction of the discharge port group, spaces between adjacent discharge ports become narrower as the spaces approach a position at which the regions in which there is a high degree of telecentricity face each other.

5. The manufacturing method of a liquid discharge head according to claim 4, wherein on a cross section in a longitudinal direction of the discharge port group, spaces between adjacent flow paths become narrower as the spaces approach a position at which the regions in which there is a high degree of telecentricity face each other.

6. The manufacturing method of a liquid discharge head according to claim 4, wherein on a cross section in a longitudinal direction of the discharge port group, spaces between the discharge energy generating elements that are adjacent become narrower as the spaces approach a position at which the regions in which there is a high degree of telecentricity face each other.

7. The manufacturing method of a liquid discharge head according to claim 4, wherein on a cross section in a longitudinal direction of the discharge port group, a center line of the flow path and a center line at a portion that contacts with the flow path of a discharge port that corresponds to the flow path coincide.

8. The manufacturing method of a liquid discharge head according to claim 7, wherein on a cross section in a longitudinal direction of the discharge port group, a center line of the flow path, a center line at a portion that contacts with the flow path of a discharge port that corresponds to the flow path, and a center line of the discharge energy generating element that corresponds to the flow path coincide.

9. The manufacturing method of a liquid discharge head according to claim 1, wherein at least one kind among the flow paths, the discharge ports and the discharge energy generating elements is formed by adjusting arrangement positions thereof so that impact positions of the liquid discharged from the discharge ports are uniform.

10. The manufacturing method of a liquid discharge head according to claim 1, comprising:

prior to the disposing of (1), forming a flow path pattern as a mold of the flow path using a positive-type photosensitive resin on or above the substrate;

wherein, in the disposing of (1), the photosensitive resin is disposed on the flow path pattern and the substrate.

11. The manufacturing method of a liquid discharge head according to claim 1, wherein the exposures are performed using an exposure apparatus that employs an optical reduction system.

* * * * *